US005120028A

United States Patent [19]

Cervi et al.

[11] Patent Number: 5,120,028

[45] Date of Patent: Jun. 9, 1992

[54] CORING PROBE IN PARTICULAR FOR A BLAST FURNACE

[75] Inventors: Antoine Cervi, Saint Martin de Crau; André Urvoy, Arles; Michel Helleisen, Saint Julien-lès-Metz; Gilbert Lanfrit, Sierck-lès-Bains; Hervé Pierret, Maizieres-lès-Metz, all of France

[73] Assignee: Techmetal Promotion, Maizieres-lès-Metz, France

[21] Appl. No.: 671,265

[22] Filed: Mar. 18, 1991

[30] Foreign Application Priority Data

Apr. 3, 1990 [FR] France ..... 90 04263

[51] Int. Cl.[5] ..... C21B 3/00

[52] U.S. Cl. ..... 266/274; 75/459; 75/469; 75/470

[58] Field of Search ..... 266/274; 75/469, 459, 75/470, 465

[56] References Cited

U.S. PATENT DOCUMENTS

| | | | |
|---|---|---|---|
| 2,057,919 | 10/1936 | Roll | 75/459 |
| 2,448,199 | 8/1948 | Vollrath | 75/465 |
| 2,918,365 | 12/1959 | Kanomori | 75/470 |

*Primary Examiner*—Peter D. Rosenberg

*Attorney, Agent, or Firm*—Frishauf, Holtz, Goodman & Woodward

[57] ABSTRACT

The coring probe is constructed in the form of a tube (1) whose front part is capable of being disassembled into at least two parts (2,3), for example an upper element (2) which is fixed in use to a lower element (3) by members (4) and screws (6). This probe may be employed several times and consequently permits achieving a marked saving relative to known probes.

11 Claims, 2 Drawing Sheets

CORING PROBE IN PARTICULAR FOR A BLAST FURNACE

BACKGROUND OF THE INVENTION

The present invention relates to coring probes which may be employed in particular in iron blast furnaces.

Among the various probings carried out in the heart of a blast furnace it is known to effect in particular a coring in a zone containing a mass of solid carbonaceous material called "dead man" located in the center of the blast furnace above the hearth.

DESCRIPTION OF THE PRIOR ART

At the present time, there is employed for carrying out such a coring a tube whose front end is bevelled so as to facilitate the penetration of the tube into the solid mass. This tube is made in a single piece and must be destroyed in order to recover the core which has been taken.

This results in relatively high cost and the object of the invention is to propose an improved coring tube which permits achieving a substantial saving relative to known devices.

SUMMARY OF THE INVENTION

The inveniton therefore provides a coring tube, in particular for a blast furnace, characterized in that the tube is constructed, in a length thereof which is at least equal to the length of the core to be taken, in at least two parts which are maintained assembled by detachable fixing means.

According to other features of the invention:

- the tube comprises at least one upper element and at least one lower element assembled in a joint plane parallel to the axis of the tube;
- this joint plane is located above the axis of the tube;
- the tube comprises a complete rear part secured to the lower element;
- the upper element carries in its rear part a curved cover adated to overlap in a sealed manner the front edge portion of the rear part of the tube;
- the tube comprises a plurality of elements whose sections progressively increase in the direction from the front end toward the rear part of the tube.

BRIEF DESCRIPTION OF THE DRAWINGS

The invention will be described in more detail hereinafter with referenece to the accompanying drawings which are given solely by way of examples and in which.

Figure 3:
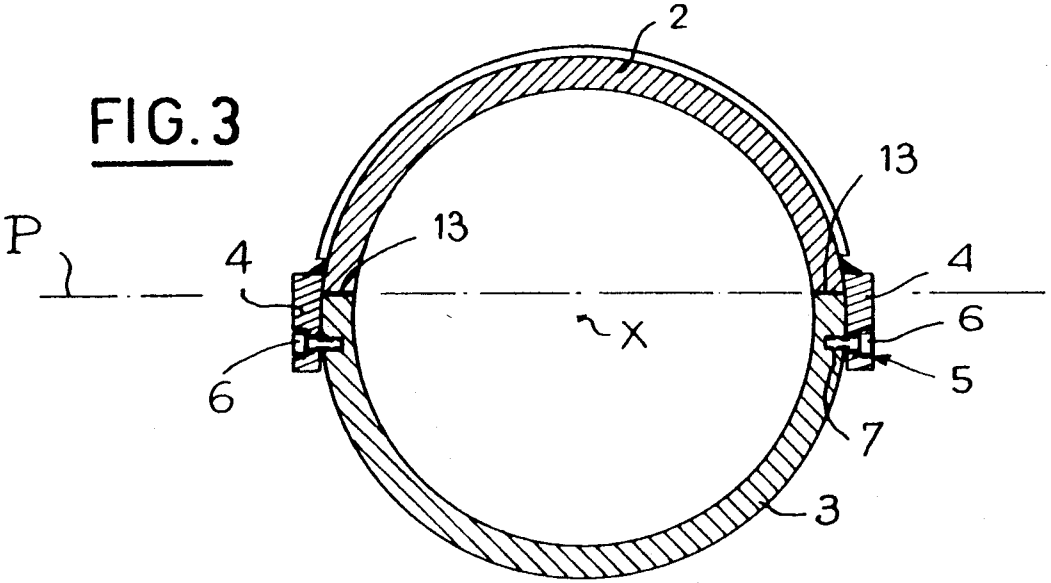
FIG. 3 is a sectional view taken on line 3—3 of FIG. 2.
Figure 1:
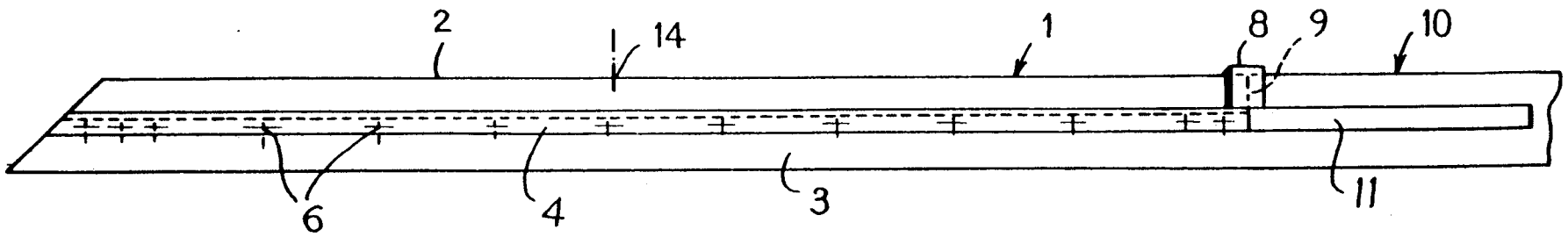
FIG. 1 is an elevational view of a coring tube according to the invention.

In the drawings there is shown a cording tube 1 for taking core samples form the so-called "dead man" zone of a blast furnace, This tube is constucted, in its front part and in a length thereof exceeding the length of the core to be taken, in two parts 2, 3 the joint plane P of which is a longitudinal plane, i.e. a plane parallel to the axis X of the tube and located either at the level of this axis or preferably slightly thereabove, as shown in the drawings and in particular in FIG. 3.

The upper detachable element 2 of the tube carries along its two free edge portions two welded flat iron bars 4 in which are provided a series of oblong openings 5 including spot facing and adapted to receive screws 6 for fixing the upper element of the tube to the lower element 3. These fixing screws are tightened in blind tapped holes 7 provided in the lower tube element.

In its rear part, the upper element carries a welded curved member 8 which constitutes a cover and is adapted to overlap the front end portion 9 of the rear part 10 of the probe constituted by a complete section of the tube. A sealing element (not shown) is interposed between this cover and the tube so as to prevent water entering at the junction between the detachable part of the tube and the main part of the latter when cooling by spraying with water after the probe has been withdrawn.

The main part of the tube comprises the complete tube section 10 and the lower element 3 which are preferably in one piece. In its rear part, the tube 10 further comprises two welded flat iron bars 11 which are located in the extension of the two flat iron bars 4 carried by the detachable element so as to provide a guiding when extracting the probe.

Figure 2:
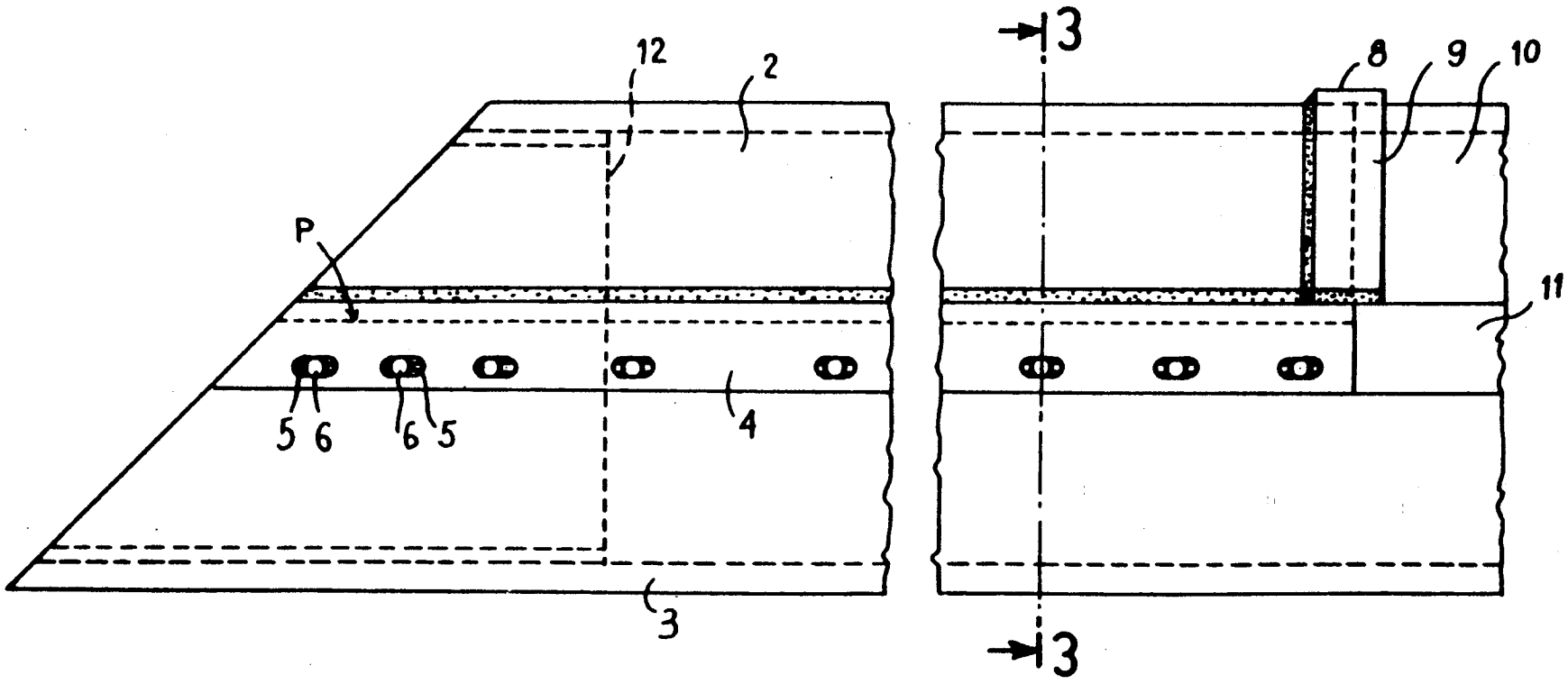
FIG. 2 is a view to a larger scale of two portions of the same tube.

Note also in FIG. 2 that, in its front part, the tube assembly has a bevelled shape, known per se, and incudes an added sheet metal member 12 for reducing the section of the passage through the tube and avoiding excesive frictional forces in the course of the penetration of the probe into the mass from which the core is taken.

Lastly, asbestos gaskets 13 are placed between the confronting surfaces of the upper element and lower element of the tube when these two elements are assembled and the detachable element 2 comprises in its median part a tapped hole 14 for fixing a lifting means. It will be understood that centring means, constituted by dowels and receiving orifices for these dowels, may be provided in the confronting faces of the two tube elements to facilitate their relative positioning.

Such an arrangement is employed in the following manner:

The two tube elements 2, 3 are first of all assembled by placing in position the aforementioned sealing elements and asbestos gaskets. The two tube elements are fixed together by means of two series of screws 6 extending through the oblong openings 5 in the two flat iron bars and screwed into the corresponding tapped holes 7 of the lower element 3. The coring is then carried out in the known manner and the probe is withdrawn after a core about 4 m or 4.5 m long has been taken. The iron guiding bars 11 facilitate this withdrawal, and suppress the risk of tearing out the rear end of the flat iron bars 4, which could occur for example by catching of solid materials fallen behind the flat iron bars during the probe penetration.

The probe is then cooled by spraying with water and then the lifting means is placed in position on the upper element (at 14) and the various screws 6 unscrewed, after which it is sufficient to lift the upper element of the tube to have access to the core. The fact that the joint plane P between the two parts of the tube is placed above a diametrical plane permits to a large extent avoiding the crumbling of the materials constituting the core.

The fact of providing oblong openings on one hand facilitates the positioning and fixing of the screws and on the other hand permits accommodating a slight relative displacement between the two parts under the effect of in particular expansions without risk of the fixing screws shearing.

Disassembly is easy and in any case much more practical than cutting the tube, which is necessary with probes of the prior art. The fact that the probe can be used again also results in a substantial economy.

As a variant, the upper element of the tube may be made in a plurality of parts whose sections progressively increase in a direction from the front part toward the rear part of the tube so as to compensate for the effect of the compacting of the material as the probe advances into the mass.

Further, the assembling and fixing means between the tube elements may be different from those shown by way of example: the tube elements may comprise radial flanges in the region of which the assembly is achieved, these flanges being bevelled in their front part. The fixing together may also be achieved without increasing the overall size of the tube by shaping the two elements in a complementary manner.

what is claimed is:

1. Apparatus for obtaining a core sample from a core mass in a blast furnace, said apparatus comprising:

an elongated tubular member having a longitudinal axis, a hollow interior portion, a front end portion, an opening in the front end portion for communicating with the hollow interior portion, and a rear end portion; and said elongated tubular member comprising at least two parts, each of the at least two parts having a length which is at least equal to a length of a core sample to be taken by said elongated tubular member;

both of the at least two parts extending from the front end portion of the elongated tubular member toward the rear end portion of the elongated tubular member, the core sample being obtained when the elongated tubular member is moved into the core mass of the blast furnace; and detachable fixing means for holding the at least two parts together when the elongated tubular member is moved into the core mass to enable the core to enter the hollow interior portion of the elongated tubular member via said opening and for enabling subsequent separation of the at least two parts to provide direct access to the core sample.

2. The apparatus according to claim 1, wherein said at least two parts comprises:

at least one upper element forming one of said parts;

at least one lower element forming the other of said parts; and the at least one upper element and the at least one lower element being detachably coupled together in a joint plane that is parallel to the longitudinal axis of the eleongated tubular member.

3. The apparatus according to claim 2, wherein: the elongated tubular member has an upper and a lower longitudinal portion; and wherein said joint plane is located in the upper longitudinal portion and above said longitudinal axis of the coring tube.

4. The apparatus tube according to claim 2, further comprising a complete rear part secured to said at least one lower element.

5. The apparatus according to claim 4, further comprising a curved cover carried by the at least one upper element in a rear part thereof;

said curved cover being positioned to overlap a front edge portion of said rear end portion of the elongated tubular member to provide a seal between the at least one upper element and the rear end portion of the elongated tubular member; and wherein each of the fixing members includes an extension having guide means therein, each extension extending toward the rear end portion of the elongated tubular member.

6. The apparatus according to claim 5, wherein:

the rear end portion of the elongated tubular member and the at least one lower element comprises a unitary structure said unitary structure having guide members which respectively fit into the guide means of the extension of each of the fixing members.

7. The apparatus according to claim 2, further comprising:

fixing members mounted on one of the at least one upper element and the at least one lower element;

each of said fixing members having first and second bearing surfaces, and openings extending between the first and second bearing surfaces;

blind tap holes formed in the other of the at least one upper element and the at least one lower element which does not have the fixing members mounted thereon; and screws means threadably engaged through the openings in the fixing members into the blind tap holes, said screw means bearing against at least one of the bearing surfaces of the fixing members for holding the at least one upper element and the at least one lower element together.

8. The apparatus tube according to claim 7, wherein said fixing members are welded flat iron bars.

9. The apparatus tube according to claim 7, wherein said openings have an oblong shape.

10. The coring tube according to claim 7 wherein the at least one lower element and the rear end portion of the elongated tubular member are formed as a unitary structure.

11. The apparatus according to claim 1, wherein each of the at least two parts comprises a plurality of elements respectively having cross-sections which pregressively increase in a dimension thereof in a direction from the front end portion of the elongated tubular member toward the rear end portion of the elongated tubular member.

* * * * *